US006814068B1

(12) United States Patent
Troncoso, Jr. et al.

(10) Patent No.: US 6,814,068 B1
(45) Date of Patent: Nov. 9, 2004

(54) ARROW SUPPORT DEVICE

(76) Inventors: Fernando V. Troncoso, Jr., 16990 Wildwood Dr., Montrose, CO (US) 81401; Vincent Troncoso, 1665 Hermosa Ct., Montrose, CO (US) 81401

( * ) Notice: Subject to any disclaimer, the term of this patent is extended or adjusted under 35 U.S.C. 154(b) by 145 days.

(21) Appl. No.: 09/713,969

(22) Filed: Nov. 16, 2000

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | |
|---|---|---|---|---|
| 4,685,439 A | * | 8/1987 | Cosentino et al. | 124/44.5 |
| 4,703,745 A | * | 11/1987 | Hammond | 124/44.5 |
| 4,748,963 A | | 6/1988 | Troncoso et al. | |
| 4,829,974 A | | 5/1989 | Anderson | |
| 4,865,007 A | | 9/1989 | Saunders | |
| 5,161,515 A | | 11/1992 | Hammonds | 124/44.5 |
| 5,181,502 A | * | 1/1993 | Ray | 124/44.5 |
| 5,415,154 A | | 5/1995 | Angeloni | 124/44.5 |
| 5,454,362 A | * | 10/1995 | Cook | 124/44.5 |
| 5,460,152 A | | 10/1995 | Specht | 124/44.5 |
| 5,490,492 A | | 2/1996 | Savage | 124/44.5 |
| 5,529,049 A | | 6/1996 | Antalosky | 124/44.5 |
| 5,601,069 A | | 2/1997 | Clark | 124/44.5 |
| 5,606,961 A | | 3/1997 | Basik et al. | 124/44.5 |
| 5,697,356 A | * | 12/1997 | Chappell | 124/44.5 |
| 5,915,369 A | | 6/1999 | Sheliga | 124/44.5 |
| 5,944,005 A | | 8/1999 | Schiff | 124/44.5 |
| 6,044,832 A | | 4/2000 | Piersons, Jr. | 124/44.5 |

* cited by examiner

*Primary Examiner*—John A. Ricci

(57) ABSTRACT

An arrow support device for holding an arrow with respect to a bow in a ready-to-draw-and-fire position. The arrow shaft is supported by an arrow rest that may be deflected downwardly against a bias. The arrow support device also includes an upper arm adapted to hold the arrow shaft against the arrow rest. The arrow rest is interconnected to the upper arm such that when the arrow rest is deflected downwardly, the upper arm concurrently automatically moves upwardly, whereby any potential contact of the arrow shaft or arrow vanes with the upper arm is minimized or eliminated.

18 Claims, 3 Drawing Sheets

ARROW SUPPORT DEVICE

FIELD OF THE INVENTION

The present invention generally relates to archery, and more particularly to an arrow support device for holding an arrow with respect to a bow in a ready-to-draw-and-fire position.

BACKGROUND OF THE INVENTION

Archery bows, such as compound bows, conventionally possess a handle riser section generally where an archer grasps the bow with one of the archer's hands. The handle riser section includes a window section through which an arrow extends when the arrow is in a "ready-to-draw-and-fire position", when the arrow is drawn rearwardly as the bowstring is drawn, and momentarily after release of the bowstring and during the initial firing of the arrow.

When an arrow is fired, the arrow both bends and is thrust downwardly. A number of arrow rests have been designed to help absorb any downward flexing or thrust of the arrow in order to improve arrow flight accuracy. Many of these arrow rests include a pair of prongs that are rotatably mounted to the bow and which extend upwardly and forwardly in the window. The prongs are spring biased into a preselected upwardly limited position, such that the tips of the prongs are adapted to receive and support the shaft of the arrow therebetween. When the arrow is released and fired, the arrow shaft will exert a downward force against the resiliently biased prong tips, which will dampen the downward flex and thrust of the arrow shaft, and which will thereby increase arrow flight accuracy. The prongs are also designed to provide free clearance of the arrow vanes or feathers when the arrow is shot.

When drawing an arrow rearwardly, the arrow may roll or fall off the tips of the prongs, which requires the arrow to be replaced and re-drawn. While such arrow "roll off" can be frustrating during target practice and disconcerting during tournaments, "roll off" is especially troublesome during hunting, when the archer may be relatively nervous, standing on unstable and uneven terrain, or encountering difficult weather conditions. During hunting, a "roll off" (1) may result in the arrow banging against the arrow rest or the bow, thereby creating noises that scare the game, (2) may require the archer to move the archer's hand, the arrow, or the bow, which movement may also scare the game, or (3) may require the archer to delay the arrow shot, during which time the game may move into concealment or out of range.

Arrow holders have been designed to help hold an arrow in the window of a bow. However, many of these holders unduly pin down and restrict the arrow so as to hamper arrow flight.

U.S. Pat. No. 5,460,152 discloses a three point arrow rest which includes a pair of lower support arms as well as an upper guide arm, the terminal ends of which are designed to contact the arrow shaft about three points substantially equilaterally arranged around the arrow shaft circumference. The support arms are resiliently biased, and the upper guide arm is also independently,resiliently biased. It will be appreciated that the guide arm does not move upwardly, away from the arrow s haft and arrow vanes unless the shaft or vanes contact the guide arm.

U.S. Pat No. 5,161,515 discloses a lower launcher arm, an upper launcher arm, and a conventional "Burger button" extending laterally from the handle riser section, whereby three point contact is made about the arrow shaft. Each of the launcher arms is resiliently flexible such that when the arrow is shot, the launcher arms may resiliently be deflected by contact with the arrow shaft or arrow vanes. Again the upper launcher arm does not deflect except upon contact wit h the arrow shaft or vanes.

SUMMARY OF THE INVENTION

The present invention relates to an arrow support device for holding an arrow with respect to a bow in a ready-to-draw-and-fire position. The arrow shaft is supported by an arrow rest that may be deflected downwardly against a bias. The arrow support device also includes an upper arm adapted to hold the arrow shaft against the arrow rest. The arrow rest is interconnected to the upper arm such that when the arrow rest is deflected downwardly, the upper arm concurrently automatically moves upwardly, whereby any potential contact of the arrow shaft or arrow vanes with the upper arm is minimized or eliminated.

BRIEF DESCRIPTION OF THE DRAWINGS

The invention will be described with reference to the accompanying drawings wherein.

DESCRIPTION OF A PREFERRED EMBODIMENT

Figure 1:
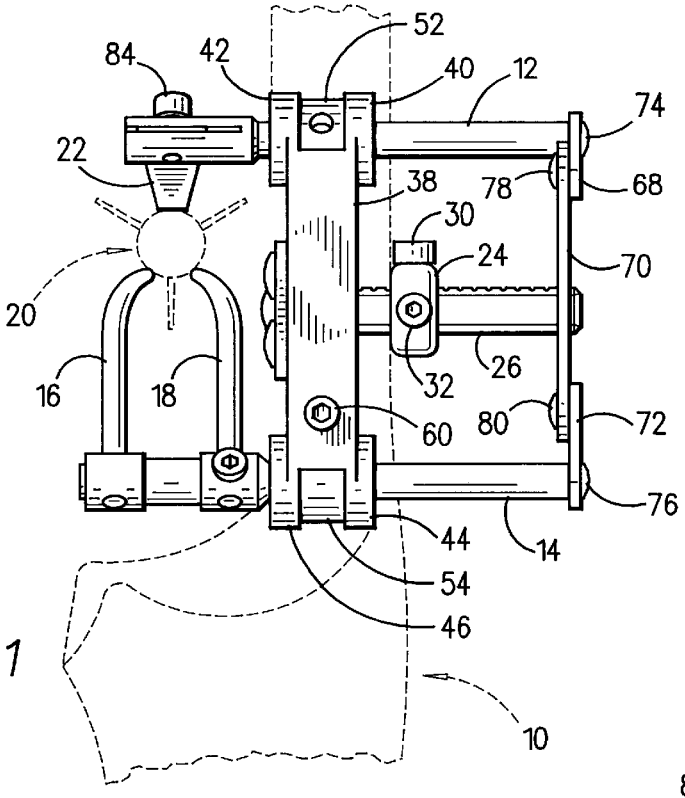
FIG. 1 is a schematic rear elevation of an arrow support device in accordance with one embodiment of the present invention.
Figure 2A:
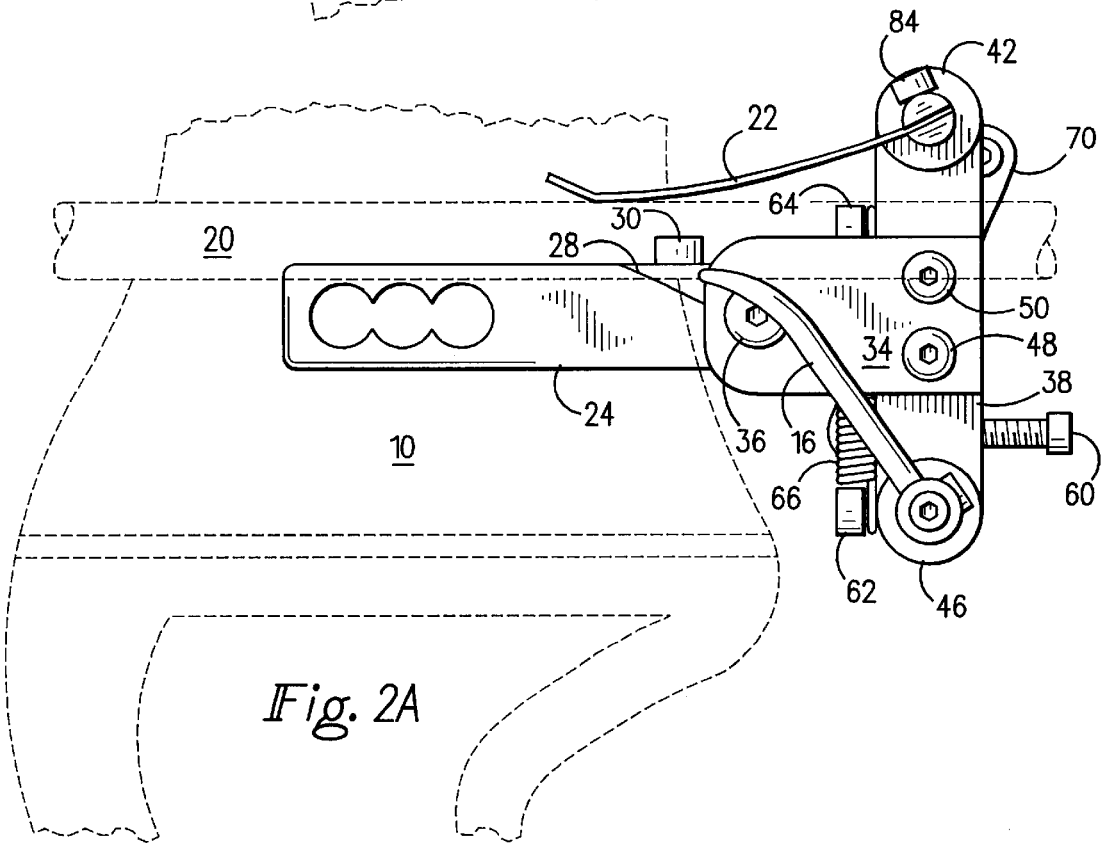
FIG. 2A is a schematic side elevation of the arrow support device as shown in FIG. 1.

The present invention will be described with reference to the accompanying drawings, wherein like reference numbers refer to the same item. There is shown in FIG. 1 in phantom lines an archery bow 10, which may be a compound bow or other type of bow. The portion of the bow 10 as shown in FIGS. 1 and 2A is generally known as the handle riser section, which includes an arrow window in which an arrow 20 is adapted to be disposed immediately prior to drawing the arrow, during the drawing of the arrow, and during firing of the arrow from the bow 10.

The arrow support device of the present invention is adapted to hold the arrow 20 in a selected position with respect to the bow 10. The support device includes a base by which the arrow support device is adapted to be mounted to the bow 10. The base maintains an upper rotatable shaft 12 and a lower rotatable shaft 14 in a substantially parallel, vertically spaced orientation. One end of the lower shaft that extends generally into the window region of the bow 10 and supports a pair of laterally spaced support arms 16, 18, as best shown in FIGS. 1 and 2A. The support arms 16, 18 are preferably fashioned in the nature of prongs that extend forwardly and upwardly in the window region. The prongs are preferably fashioned of a rigid material and may be coated with plastic or TEFLON® to help reduce frictional engagement (and associated noise) of the prongs with the arrow shaft when the arrow 20 is drawn and fired. The tips of the support arms 16, 18 are tapered and rounded and are curved toward the adjacent support arm. As best shown in FIG. 1, the shaft or spine of the arrow 20 is adapted to rest upon and to be centered above the converging tips of the support arms 16, 18.

It should be appreciated that instead of a pair of laterally spaced support arms 16, 18, a single support arm having a forked or crotched upper end may be utilized to help cradle the arrow shaft in a selected position. Also, although rigid support arms are preferred, it is within the scope of the present invention that resiliently flexible support arms may also be utilized.

As best shown in FIG. 1, one end of the upper shaft 12 also laterally extends into the window region of the bow 10. A guide arm 22 is radially mounted on the end of the upper shaft 12 such that the guide arm 22 extends forwardly and downwardly in the window region. The guide arm 22 is preferably fashioned of a flat, thin sheet of plastic or TEFLON®, again to help reduce frictional engagement of the arrow shaft with the guide arm 22 and to reduce any noise associated with such friction. The guide arm 22 is preferably slightly resiliently flexible rather than rigid, however, it is contemplated within the scope of this invention that the guide arm 22 may be fashioned of a substantially rigid material. Also, instead of a single guide arm 22, a pair of guide arms could be employed.

It will be appreciated that the distal end of the guide arm 22 is bent slightly upwardly at an angle of approximately 150 degrees whereby a shallow "V" shaped bend is configured in the guide arm 22 approximately one-half centimeter from the distal tip of the guide arm 22. It will be appreciated that if the edge of the distal tip of the guide arm 22 contacted the arrow shaft, then when the arrow 20 is drawn, the guide arm 22 might be subjected to more extreme frictional forces upon drawing the arrow 20, which might cause the guide arm 22 to buckle or might cause an associated noise. Nevertheless, it is contemplated within the present invention that many other configurations of a distal tip of the guide arm 22 may be effectively used. For example, the "V" shaped bend might be in the range of 160 degrees to 120 degrees, and the length of the distal tip of the guide arm 22 from the bend area might be in the range of two millimeters to one centimeter. Also, the distal end of the guide arm 22 may be fashioned in a curved bend, rather than a "V" shaped bend. Also, the distal end of the guide 22 may sue a concave shape that substantially conforms to the periphery of an arrow shaft. Since arrow shafts are designed with different diameters, and different peripheral curvatures, the distal end of the guide arm 22 may be fashioned with any one of a variety of concave contours.

The invention contemplates that the guide arm 22 will not contact or otherwise interfere with the arrow 20 immediately after the arrow 20 is fired. Although at the instant of firing, the distal end of the guide arm 22 will be in contact with the shaft of the arrow 20, the arrow support device of the present invention contemplates that the guide arm 22 will rotate and move upwardly in the arrow window immediately after firing the arrow 20 so that the guide arm 22 does not contact the arrow shaft or the arrow vanes. Accordingly, it is contemplated that the guide arm 22 is preferably tapered at its distal end, with a width of approximately three millimeters, although widths of two millimeters to five millimeters are also preferred. With such a relatively narrow distal end of the guide arm 22, and with the guide arm 22 being rotatable upwardly, any contact of the arrow shaft or arrow vanes with the guide arm should be eliminated, however, if there should be any such contact, the guide arm 22 is flexible to provide negligible resistance.

Figure 2B:
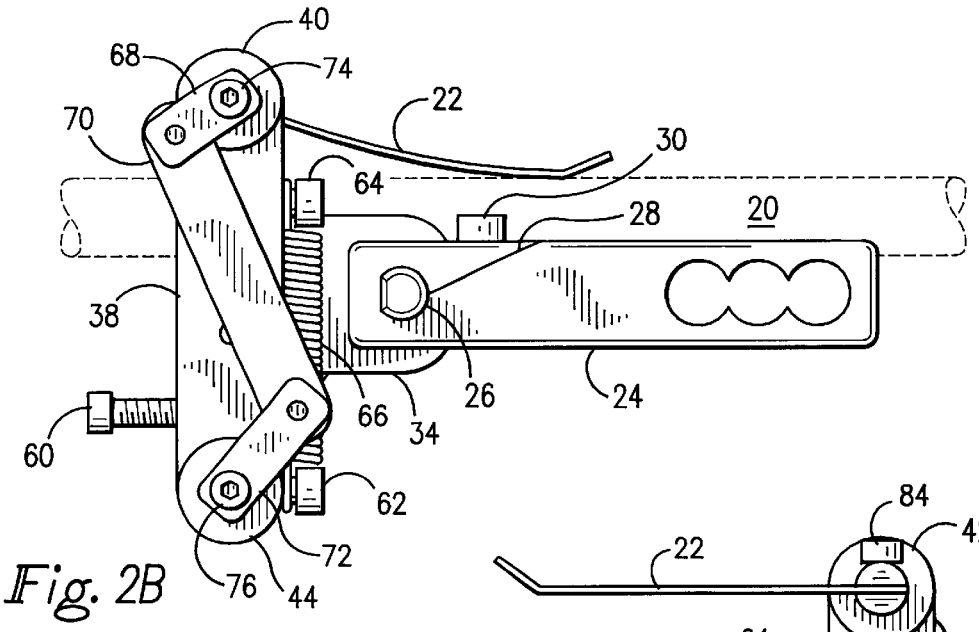
FIG. 2B is a schematic side elevation of the arrow support device as shown in FIGS. 1 and 2A, from the side opposite the side shown in FIG. 2A.

As best shown in FIGS. 1, 2A, and 2B , the guide arm 22 is positioned in the window region directly and centrally above the curved tip ends of the support arms 16, 18, and is adapted to provide a slight downward force against the arrow shaft so that the arrow shaft is slightly forcefully seated on and between the curved tip ends of the support arms 16, 18. Such a design helps maintain the arrow 20 in a ready-to-draw-and-fire position either during target shooting or especially during hunting and prevents "roll off" during the drawing of the arrow. The arrow support device also does not interfere with the drawing or firing of the arrow 20, and is essentially quiet.

Figure 3A:
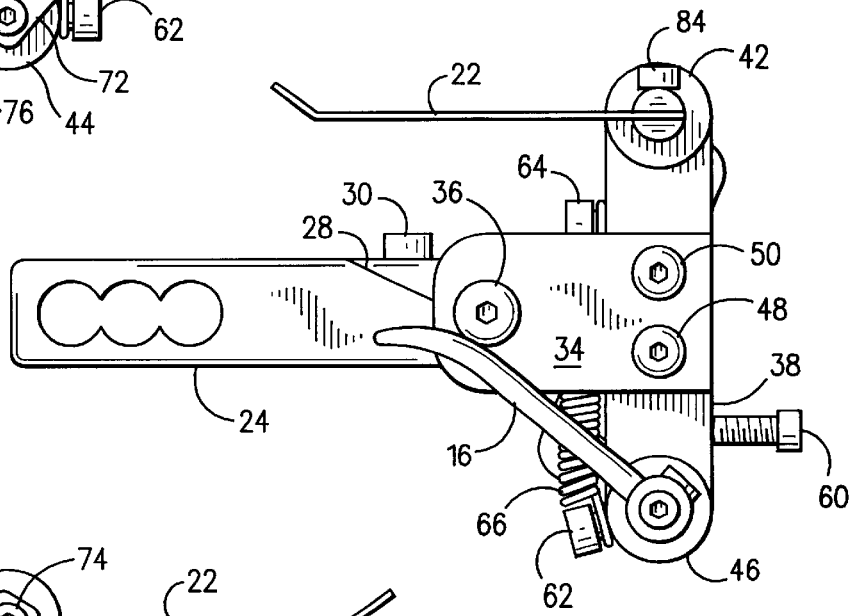
FIG. 3A is a schematic side elevation of the arrow support device as shown in FIG. 2A, after the arrow has been fired, showing a downward movement and rotation of the arrow support arms and an upward movement and rotation of the guide arm.
Figure 3B:
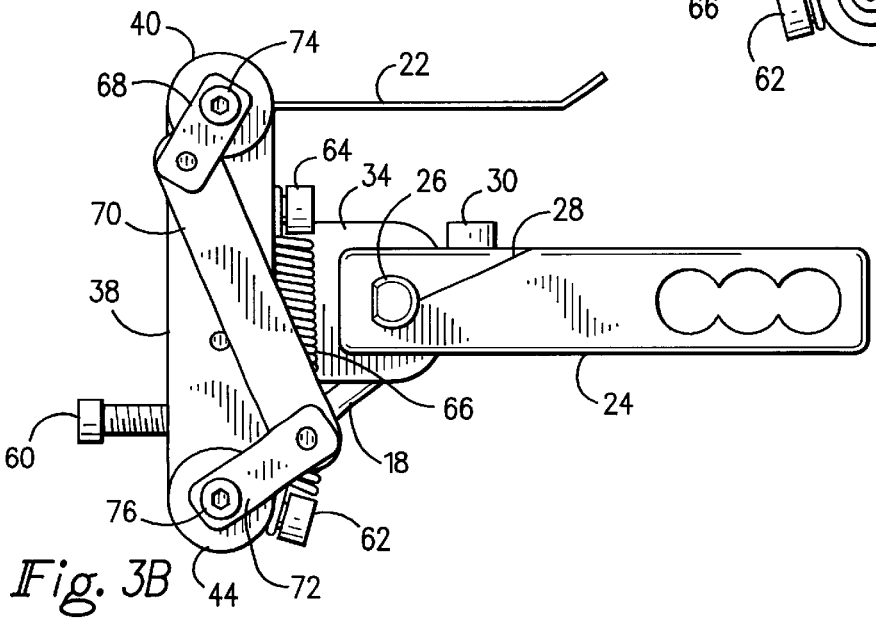
FIG. 3B is a schematic side elevation of the arrow support device as shown in FIG. 3A, from a side opposite to that shown in FIG. 3A.

The base for supporting the rotatable shafts 12, 14, the support arms 16, 18, and the guide arm 22 will now be described. The base includes a generally flat, metal mounting plate 24, as best shown in FIGS. 2B, 3A, and 3B. The mounting plate is adapted to be placed forcibly against the outside surface of the bow 10 along the handle riser section with bolts or screws, in a well-known manner. The mounting plate 24 generally comprises a rectangularly shaped body with three interconnected holes disposed near one end thereof. The centers of the holes extend along a common line, and each hole possesses the same diameter. When the mounting plate 24 is secured by a bolt, screw, or the like to the handle riser section of the bow 10, the archer may select one of the three holes in which to place the bolt, screw, or the like, which will concomitantly cause the support arm 16, 18 and the guide arms 22 to be adjustably positioned backwardly or forwardly with in the window region of the bow 10.

Figure 4:
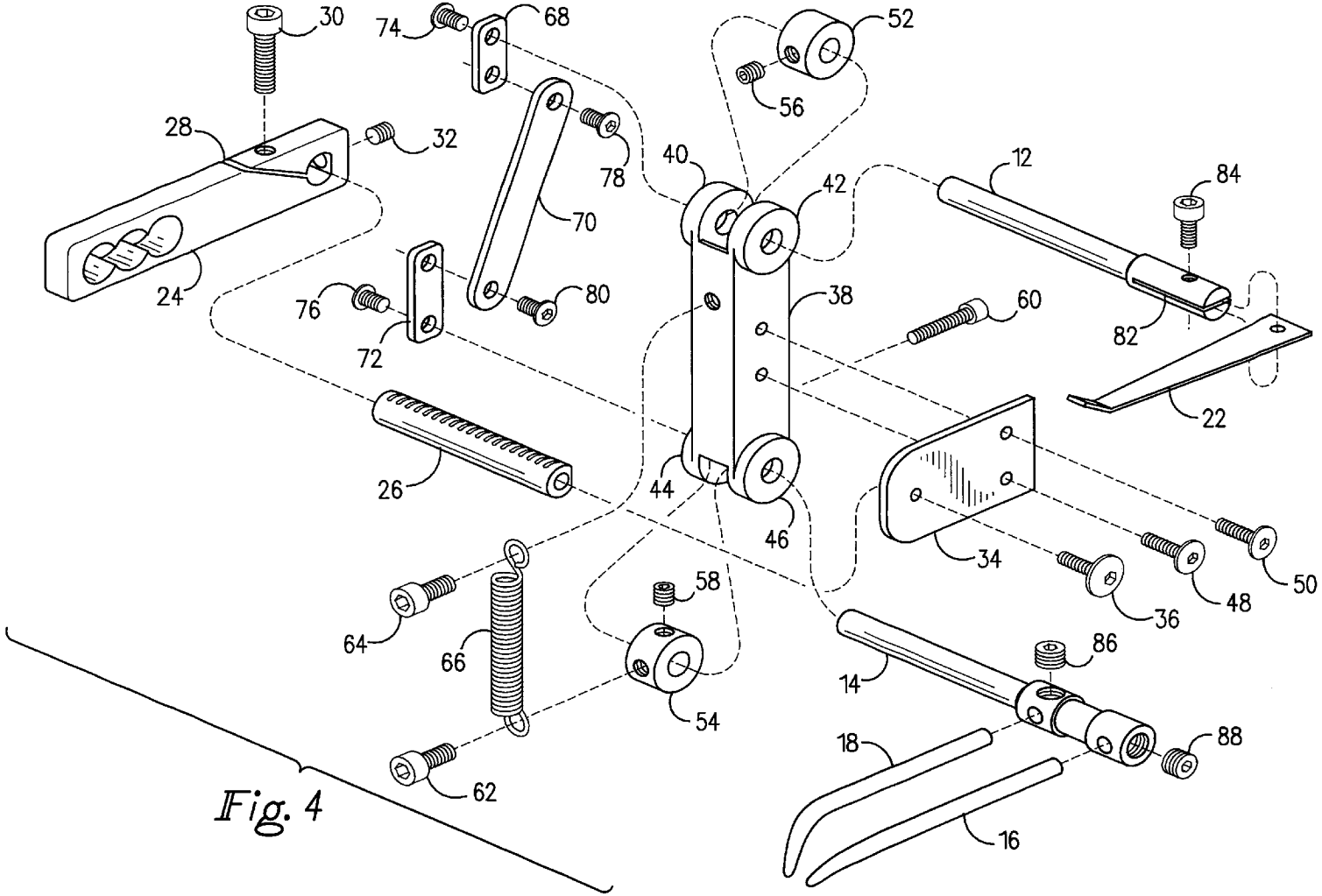
FIG. 4 is an exploded perspective view of the arrow support device illustrated in FIG. 1.

Another hole extends laterally through the mounting plate 24 near the other end thereof. Such hole includes a relatively flattened section that is adapted receive a laterally extending notched rod 26, also having a flattened section that is adapted to mate with the flattened section of the hole in the mounting plate 24. A straight line cut 28 is made in the mounting plate 24 from an upper surface thereof and angled toward the flattened hole in which the notched rod 26 is adapted to extend. A threaded cavity (shown in FIG. 4) extends from the upper surface of the mounting plate 24 through the line cut 28, and is adapted to receive a threaded screw 30. By tightening the threaded screw 30, the notched rod 26 is clamped within its associated hole within the mounting plate 24, whereas by loosening the screw 30, the notched rod 26 is unclamped, and may be withdrawn from such hole. As best shown in FIGS. 1 and 4, the notched rod 26 possesses a series of notches on the upper and lower surfaces thereof, so that when the screw 30 is tightened, the compression of the mounting plate 24 in the vicinity of the flattened hole more securely prevents the notched rod 26 from inadvertently moving laterally within its associated flattened hole within the mounting plate 24. To further help secure the notched rod 26 from lateral movement with respect to the mounting plate 24, a threaded cavity (shown in FIG. 4) extends from the end of the mounting plate 24 to the flattened hole, and a set screw 32 is adapted to be threadably disposed within the threaded cavity, whereby tightening of the set screw 32 causes the set screw 32 to press against the flattened surface of the notched rod 26, thereby providing farther assistance in preventing the notched rod 26 from inadvertent lateral movement with respect to the mounting plate 24. It will be appreciated that the lateral position of the notched rod 26 relative to the mounting plate 24 may be selectively adjusted so that the lateral position of the guide arm 22 and the support arms 16, 18 may be correspondingly selectively laterally adjusted within the window.

One end of the notched rod 26 includes a longitudinally extending threaded cavity, as shown in FIG. 4, and is adapted to abut a metal extension plate 34. As best shown in FIG. 4, the extension plate 34 possesses three laterally extending holes therein, one hole disposed toward one end thereof and adapted to be aligned with the longitudinal threaded cavity in one end of the notched rod 26, and the other two holes disposed toward the other end of the extension plate 34. A screw 36 is adapted to extend through one of the holes in the extension plate 34 and into the longitudinal threaded cavity within the notched rod 26. By tightening the screw 36, the notched rod 26 is forcibly clamped against the extension plate 34, whereupon frictional engagement of the abutting end of the notched rod 26 with the surface of the extension plate 34 prevents the notched rod 26 from rotational movement with respect to the extension plate 34. Preferably a split ring washer (not shown) may be inserted between the extension plate 34 and the head of the screw 36 to enhance the tightening condition.

The other end of the extension plate 34 is adapted to abut a side of a substantially vertically extending bracket 38. The bracket 38 may be fashioned of a single, integral piece of metal, or may be fashioned in segments. As best shown in FIG. 4, the extension plate 34 is secured to the bracket 38 by a pair of threaded cavities extending through a side of the bracket 38, which align with corresponding holes disposed toward one end of the extension bracket 34. A pair of screws 48, 50 are adapted to extend to the holes in the extension plate 34 and into the threaded cavities in the side of the bracket 38 to secure the extension plate 34 to the side of the bracket 38.

The bracket 38 includes a pair of cylindrical ears 40, 42 and 44, 46 at the upper end and at the lower end thereof. Each pair of ears 40, 42, and 44, 46 possesses a pair of centrally aligned holes therethrough, such that the upper ears 40, 42 are adapted to receive the upper shaft 12 therethrough, and the lower ears 44, 46 are adapted to receive the lower shaft 14 therethrough. An associated cylindrical collar 52, 54 is adapted to rest between the pair of upper ears 40, 42 and the lower ears 44, 46, respectively, in order to receive the upper shaft 12 and the lower shaft 14 therethrough, respectively. The upper collar 52 preferably possesses a threaded hole radially extending therethrough, which is adapted to receive a set screw 56, whereby the upper collar 52 may be clamped against the upper shaft 12 such that the upper collar 52 rotates with the upper shaft 12. Similarly, a threaded cavity may radially extend through the lower collar 54, which is adapted to receive a set screw 58, whereby the lower collar 54 may be clamped against the lower shaft 14 for concurrent rotation therewith.

The forward region of the bracket 38 in the vicinity of the lower ears 44, 46 is hollowed so as to receive the outer region or head of the set screw 58 extending into the lower collar 54. The rear face of the bracket 38 immediately behind the hollowed section possesses a threaded cavity through which a relatively elongated screw 60 is adapted to extend. The head of the set screw 58 is designed to abut against the tip of the elongated screw 60. It will be appreciated by tightening or loosening the elongated screw 60, the rotation of a lower shaft 14 may be limited to varying degrees. Preferably, the elongated screw 60 may be used to alter the limit of the angle of rotation of the lower shaft 14 by up to about 25 degrees to 45 degrees. The elongated screw 60 thus is used to vary the uppermost angle of rotation of the support arms 16, 18 and the uppermost position of the tips of the support arms 16, 18.

The lower collar 54 also possesses a second threaded cavity extending radially therethrough, which is adapted to receive another screw 62, which also may clamp the lower collar 54 against the lower shaft 14. The upper forward face of the bracket 38 may further possess a threaded cavity adapted to receive a screw 64. Each of these two screws 62, 64 is adapted to extend through a corresponding coiled end of an extension spring 66. It will thus be appreciated that any downward rotation of the support arms 16, 18 (which causes a concomitant rotation of the shaft 14) will also concomitantly cause the lower collar 54 to rotate and to rotate downwardly the screw 62 against the bias of the extension spring 66. Thus, the extension of spring 66 causes the support arms 16, 18 to be biased toward a relatively upward position, which is limited by the abutment of the head of the set screw 58 with the end of the elongated screw 60.

The longitudinal ends of the upper shaft 12 and the lower shaft 14, away from the guide arm 22 and the support arms 16, 18, respectively, are interconnected through a mechanical linkage system so that the rotation of one shaft will cause a concomitant opposite rotation of the other shaft, and more particularly, rotation of the lower shaft 14 will cause a concomitant opposite rotation of the upper shaft 12. The linkage system includes an upper, short length linkage arm 68, an intermediate, long length linkage arm 70, and a lower, medium length linkage arm 72. Each end of the upper linkage arm 68 possesses a hole therethrough, with one end of the upper linkage arm 68 adapted to abut the associated end of the upper shaft 12, which possesses a longitudinally extending threaded cavity (not shown). A screw 74 extends through the hole in the upper linkage arm 68 and into the associated longitudinal treaded cavity in the end of the upper shaft 1 to tightly clamp the upper linkage arm 68 to the associated end of the upper shaft 12 whereby the upper linkage arm 68 rotates concurrently with the upper'shaft 12.

Likewise, the lower linkage arm 72 possesses a hole in each end thereof with one hole adapted to align with a longitudinally extending threaded cavity (not shown) within the associated end of the lower shaft 14. A screw 76 is adapted to extend into the associated longitudinal threaded cavity and to tightly clamp the lower linkage arm 72 against the associated end of the lower shaft 14 such that the lower linkage arm 72 rotates concurrently with the lower shaft 14.

The intermediate linkage arm 70 possesses holes disposed toward each longitudinal end thereof, which are adapted to align with the other hole in the upper linkage arm 68 and the other hole in the lower linkage arm 72. A screw 78 extends loosely through the aligned holes in the intermediate linkage arm 70 and the upper linkage arm 68 such that each linkage arm may rotate about the screw 78. Likewise, a screw 80 extends loosely through the aligned holes in the intermediate linkage arm 70 and the lower linkage arm 72 such that each linkage arm may rotate about the screw 80.

As best shown in FIGS. 2B and 3B, the linkage arms 68, 70, 72 are arranged in a somewhat "S" configuration. It will be further appreciated from viewing FIGS. 2B and 3B that rotation of one of the shafts 12, 14 will be translated through the linkage system to cause a concomitantly opposite rotation of the other shaft 12, 14.

The guide arm 22 is mounted on the end of the upper shaft 12 opposite to the linkage system. The end of the upper shaft 12 on which the guide arm 22 is mounted possesses a slightly larger diameter than the remainder of the upper shaft 12. Such end of the upper shaft 12 also possesses a slit 82 longitudinally extending from the end face of the upper shaft 12, diametrically there across. The longitudinal end of the guide arm 22 opposite to the tapered distal end possesses a hole therethrough Such end of the guide arm 22 is adapted to extend through the slit 82 in the end of the upper shaft 12. It will appreciated that the thickness of the slit 82 is approximately equal to, and preferably only slightly larger than, the thickness of the guide arm 22 portion extending into the slit 82. A threaded cavity extends radially through the end of the upper shaft 12 and through the slit 82. A screw 84 is adapted to extend through the threaded cavity, and through the hole in the end of the guide arm 22, as best shown in FIG. 4. Thus, the screw 84 helps clamp the guide arm 22 into a selected position extending radially away from the upper shaft 12, and helps prevent any sliding or twisting of the guide arm 22 relative to the upper shaft 12.

The end of the lower shaft 14 opposite the linkage system also possesses a relatively enlarged diameter region. The ends of the support arms 16, 18 opposite the curved ends extend through corresponding laterally spaced holes radially extending through the enlarged diameter end of the lower shaft 14, as best shown in FIG. 4. A threaded cavity also radially extends into the enlarged diameter region near one of the support arms 18, and a set screw 86 threadably extends into such cavity to forcibly secure and clamp the support arm 18 into a selected position. Similarly, a threaded cavity extends longitudinally from such end of the lower shaft 14, and a set screw 88 extends through the cavity to forcibly clamp the other support arm 16 into a selected position.

It should be appreciated from a description of the foregoing arrow support device, that the device is reversible in the sense that it may be adapted equally for either right-handed or left-handed archers.

It will be appreciated that the guide arm 22 forcibly presses the shaft of the arrow 20 against the curved tip ends of the support arm 16, 18 (which are maintained in an upward rotational position by the action of the spring 66 and which position is limited by the abutment of set screw 58 against the end of the elongated screw 60) so that the arrow 20 is maintained in a ready-to-draw-and-fire position and so that when the archer draws the arrow, the possibility of arrow "roll off" is eliminated, or at least minimized. To insure proper arrow tuning (e.g., to insure that the arrow shaft is properly positioned vertically), the force of the guide arm 22 should not overcome the force of the bias of the spring 66, so that the arrow shaft is consistently supported at the same uppermost position of the support arms 16, 18. Because the guide arm 22 is preferably resiliently flexible, the forceful pressing of the distal end of the guide arm 22 against the arrow shaft will create a slight bow or bend of the guide arm 22. It will also be appreciated that the guide arm 22 is fashioned such that the guide arm 22 does not interfere with drawing of the arrow 20 and does not cause noise.

Once the arrow 20 is drawn and then fired, the arrow 20 will move forcefully downward in accordance with well-known principles. The shaft of the arrow 20 will press the tips of the support arms 16, 18 downwardly against the bias of the extension spring 66. Such downward movement of the tips of the support arms 16, 18 causes the support arms 16, 18 to rotate forwardly and downwardly within the window of the bow 10, which is translated to a rotation of the lower shaft 14. Such rotation of the lower shaft 14 is transmitted through the linkage system to cause an opposite rotation of the upper shaft 12, which in turn causes the guide arm 22 to rotate forwardly and upwardly in the window of the bow 10. Thus, the shooting of the arrow 20 forcibly causes the tips of the support arms 16, 18 to move downwardly in the window, and in accordance with the arrow support device of the present invention, automatically causes the guide arm 22 to concomitantly rotate forwardly and upwardly in the window, in response thereto. When the guide arm 22 moves upwardly, it will be appreciated that the guide arm 22 moves out of the way of the arrow shaft and arrow vanes, or at least minimizes the potential for any contact with the arrow shaft or arrow vanes. Also, even if the arrow shaft or arrow vanes were to contact the guide arm 22, the orientation of the guide arm 22 in an almost horizontal position as well as the resilient flexibility of the guide arm 22 would cause virtually negligible interference with the flight of the arrow 20.

Although the linkage system could be designed so that there is a one to one correspondence in the amount of rotational transfer from the lower shaft 14 to the upper shaft 12, that is, so that for every one degree of rotation of the lower shaft 14, there is one degree of opposite rotation of the upper shaft 12, the invention contemplates that the linkage system can be designed (such as by changing lengths of the links of the linkage arms 68, 70, 72) so that the relative amount of rotation is other than one to one. For example, the invention contemplates that for every one degree of rotation of the lower shaft 14, there would be two degrees of opposite rotation of the upper shaft 12. The invention contemplates that the linkage system may be designed so that for one degree of rotation of the lower shaft 14 there is a range from about one-half degree to four degrees of rotation in the opposite direction of the upper shaft 12.

Also, it should be noted that the amount of upward or downward movement of the distal end of the guide arm 22 and the tips of the support arms 16, 18, respectively, is relative to the lengths of the guide arm 22, an e support arms 16, 18 as well as the relative degree of rotation of the guide arm 22 and the support arms 16, 18. Thus, the invention also contemplates that for every unit length of downward movement of the tips of the support arms 16, 18, the distal end of the guide arm 22 may move upwardly a preselected number of unit lengths. So, for example, the linkage system as well as the lengths of the guide arm 22 and the support arms 16, 18 may be selected to provide that for the first five millimeters of downward movement of the tips of the support arms 16, 18, the distal end of the guide arm 22 moves upwardly in the range of about three millimeters to one centimeter. Again, preferably, the amount of upward movement of the guide arm 22 is greater than the rate of downward movement of the tips of the support arms 16, 18. Such a condition helps insure that the guide arm 22 moves out of the way of the arrow 20 even when the support arms 22 are depressed only slightly downward when the arrow is fired.

Although particular embodiments of the particular invention are described and illustrations herein, it should be recognized that modifications and variations may readily occur to those skilled in the art and that such modifications and variations may be made without departing from the spirit and scope of our invention. Consequently, my invention as claimed below may be practiced otherwise than as specifically described above.

What is claimed is:

1. An arrow support device adapted to be attached to a bow and adapted to hold an arrow with respect to a bow, said support device comprising:

a base member;

an upper shaft mounted on and rotatable with respect to said base member;

a lower shaft mounted on and rotatable with respect to said base member, said upper shaft and said lower shaft extending in a vertically, spaced apart, substantially parallel relation;

a guide arm connected to, substantially pivotable about and rotatable with, and extending substantially downwardly and forwardly from said upper shaft;

a pair of laterally spaced support arms connected to, substantially pivotable about and rotatable with, and extending substantially upwardly and forwardly from said lower shaft, said support arms being disposed substantially below said guide arm such that said guide arm is positioned substantially directly above the spaced region between said support arms; and means for causing said guide to move upwardly concurrently when said support arms move downwardly.

2. An arrow support device according to claim 1 wherein said support arms are each substantially rigid.

3. An arrow support device according to claim 2 wherein said guide arm is substantially resiliently flexible.

4. An arrow support device according to claim 3 wherein said guide arm is formed substantially of TEFLON®.

5. An arrow support device according to claim 1 wherein said guide arm is substantially resiliently flexible.

6. An arrow support device according to claim 5 wherein said guide arm is formed substantially of TEFLON®.

7. An arrow support device according to claim 1 wherein said device is reversible for use by either right or left handed archers.

8. An arrow support device for holding an arrow with respect to a bow, said support device comprising means for supporting the arrow in a ready-to-draw-and-fire position during the draw of the arrow and adapted to move downwardly upon the shooting of the arrow from the bow;

means for holding the arrow in said position forcefully against said support means while the arrow is in a ready-to-draw-and-fire position and during the draw of the arrow and adapted to move upwardly upon the shooting of the arrow from the bow; and means for causing said holding means to move upwardly concurrently when said support means moves downwardly upon the shooting of the arrow from the bow.

9. An arrow support device according to claim 8 wherein said device is reversible for use by either right or left handed archers.

10. An arrow support device adapted to be attached to a bow and adapted to hold an arrow with respect to a bow, said support device comprising:

a base member;

an upper shaft mounted on and rotatable with respect to said base member;

a lower shaft mounted on and rotatable with respect to said base member, said upper shaft and said lower shaft extending in a vertically spaced apart, substantially parallel relation;

at least one guide arm connected to, substantially pivotable about and rotatable with, and extending substantially downwardly and forwardly from said upper shaft;

at least one support arm connected to, substantially pivotable about and rotatable with, and extending substantially upwardly and forwardly from said lower shaft, said at least one support arm being disposed substantially below said at least one guide arm such that the shaft of the arrow is compressed between said at least one support arm and said at least one guide arm;

means for causing said at least one guide arm to rotate upwardly about said upper shaft in response to said at least one support arm rotating downwardly about said lower shaft.

11. An arrow support device according to claim 10 wherein said upper shaft rotates in one rotational direction in response to said lower shaft rotating in an opposite rotational direction.

12. An arrow support device according to claim 10 wherein said upper shaft rotates in the range of about one-half to four degrees for every degree of rotation said lower shaft.

13. An arrow support device according to claim 10 wherein said upper shaft rotates more than one degree for every degree of rotation of said lower shaft.

14. An arrow support device according to claim 10 wherein said device is reversible for use by either right or left-handed archers.

15. An arrow support device for holding an arrow with respect to a bow, said support device comprising means for supporting the arrow in a ready-to-draw-and-fire position during the draw of the arrow and adapted to move downwardly upon the shooting of the arrow from the bow;

means for pressing the arrow against said support means while the arrow is in a ready-to-draw-and-fire position and during the draw of the arrow and adapted to move upwardly; and means for causing said pressing means to move upwardly in response to said support means moving downwardly upon the shooting of the arrow from the bow.

16. An arrow support device according to claim 15 wherein said pressing means moves upwardly in the range of about three millimeters to one centimeter when the support means moves downwardly an initial five millimeters.

17. An arrow support device according to claim 15 wherein said pressing means moves upwardly farther than said support means moves downwardly.

18. An arrow support device according to claim 15 wherein said device is reversible for use by either right or left-handed archers.

* * * * *